US010618727B2

(12) United States Patent
Lee et al.

(10) Patent No.: US 10,618,727 B2
(45) Date of Patent: Apr. 14, 2020

(54) FLEXIBLE PAIL

(71) Applicant: Munchkin, Inc., Van Nuys, CA (US)

(72) Inventors: Agnes Yena Lee, Los Angeles, CA (US); Sung Yun Chan, Pasadena, CA (US); Kevin Douglas Johnson, Tarzana, CA (US); Matthew Joseph Saxton, Agoura, CA (US)

(73) Assignee: Munchkin Inc., Van Nuys, CA (US)

( * ) Notice: Subject to any disclaimer, the term of this patent is extended or adjusted under 35 U.S.C. 154(b) by 0 days.

(21) Appl. No.: 16/217,425

(22) Filed: Dec. 12, 2018

(65) Prior Publication Data

US 2019/0177082 A1 Jun. 13, 2019

Related U.S. Application Data

(60) Provisional application No. 62/688,795, filed on Jun. 22, 2018, provisional application No. 62/628,771, filed on Feb. 9, 2018, provisional application No. 62/597,782, filed on Dec. 12, 2017.

(51) Int. Cl.

| | |
|---|---|
| ***B65F 1/00*** | (2006.01) |
| ***B65F 1/12*** | (2006.01) |
| ***B65F 1/16*** | (2006.01) |
| *B65F 1/14* | (2006.01) |

(52) U.S. Cl.

CPC ..... *B65F 1/0073* (2013.01); *B65F 1/002* (2013.01); *B65F 1/12* (2013.01); *B65F 1/1607* (2013.01); *B65F 1/1421* (2013.01); *B65F 2001/1669* (2013.01); *B65F 2001/1676* (2013.01); *B65F 2210/167* (2013.01); *B65F 2220/106* (2013.01);

(Continued)

(58) Field of Classification Search

CPC ..... B65F 1/0073; B65F 1/0053; B65F 1/002; B65F 1/0006; B65F 1/125; B65F 1/12; B65F 1/1607; B65F 1/16; B65F 1/1421; B65F 1/141; B65D 37/00; B65D 7/02

USPC ..... 220/9.3, 9.2, 9.1, 4.05, 4.08, 908.1, 908, 220/832, 831, 810, 495.08, 666, 495.06; 383/59, 84; 150/900

See application file for complete search history.

(56) References Cited

U.S. PATENT DOCUMENTS 1,700,615 A * 1/1929 O'Brien ..... B65D 81/3897 220/592.24

1,842,603 A * 1/1932 Gray ..... B65F 1/1646 220/831

(Continued)

FOREIGN PATENT DOCUMENTS

WO 2011089275 7/2011

OTHER PUBLICATIONS

Nternational Search Report and Written Opinion for PCT/US18/65249, dated Mar. 15, 2019 (15 pages).

*Primary Examiner* — Robert J Hicks

(74) *Attorney, Agent, or Firm* — Robert Z. Evora, Esq.

(57) ABSTRACT

A flexible diaper pail having a container that is adapted to stand upright. The container may have a flexible sheet, a cover, a base, a flap and an odor barrier. The cover may be attached to a first upper end of the flexible sheet, while the base may be attached to a second lower end of the flexible sheet. The cover may have a flap pivotably attached thereto, such that the flap is adapted to pivot between an open position and a closed position. The cover may further have an opening and an odor barrier disposed in the opening.

11 Claims, 21 Drawing Sheets

(52) U.S. Cl.
CPC ..... *B65F 2240/132* (2013.01); *B65F 2250/00* (2013.09)

(56) References Cited

U.S. PATENT DOCUMENTS

| | | | | | |
|---|---|---|---|---|---|
| 2,079,052 | A * | 5/1937 | Tamini | B65D 45/22 | 220/318 |
| 2,954,891 | A * | 10/1960 | Imber | B65D 81/3834 | 383/20 |
| 3,014,516 | A * | 12/1961 | Mueller | B65D 37/00 | 220/9.2 |
| 4,143,762 | A * | 3/1979 | Spiegelberg | B65D 83/0894 | 206/210 |
| 4,921,196 | A * | 5/1990 | Rudko | B65B 67/12 | 220/495.11 |
| 4,948,266 | A | 8/1990 | Bencic | | |
| 5,960,983 | A | 10/1999 | Chan | | |
| 9,469,474 | B2 | 10/2016 | Austin et al. | | |
| 2002/0036203 | A1 * | 3/2002 | Stewart | B65D 33/02 | 220/9.2 |
| 2002/0182102 | A1 * | 12/2002 | Fontenot | A61F 13/551 | 422/5 |
| 2005/0079372 | A1 * | 4/2005 | Schmal | B32B 27/08 | 428/482 |
| 2006/0261074 | A1 | 11/2006 | Nguyen | | |
| 2008/0118188 | A1 | 5/2008 | Jones | | |
| 2011/0101014 | A1 | 5/2011 | Conrad | | |
| 2012/0217247 | A1 * | 8/2012 | Adkins | B65F 1/0006 | 220/495.08 |
| 2013/0341328 | A1 * | 12/2013 | Schneider | B65F 1/1607 | 220/259.2 |
| 2014/0233872 | A1 | 8/2014 | Stark et al. | | |
| 2015/0344170 | A1 | 12/2015 | Schneider et al. | | |

* cited by examiner

FLEXIBLE PAIL

CROSS REFERENCE TO RELATED APPLICATIONS

This application incorporates and claims the benefit of the filing date of U.S. Provisional Patent Application Ser. No. 62/688,795, entitled "FLEXIBLE PAIL" filed Jun. 22, 2018; and U.S. Provisional Patent Application Ser. No. 62/628,771, entitled "FLEXIBLE PAIL" filed Feb. 9, 2018; and U.S. Provisional Patent Application Ser. No. 62/597,782, entitled "FLEXIBLE PAIL" filed Dec. 12, 2017, the entirety of which are incorporated herein by reference.

TECHNICAL FIELD

The subject disclosure relates to a waste disposal system. More specifically, to a flexible diaper pail having substantial rigidity to enable the flexible diaper pail to stand upright.

BACKGROUND

Traditional diaper pails are generally inflexible, bulky, rigid and cumbersome. Furthermore, these diaper pails are not compact or readily portable. Thus, a need arises for parents who want to have alternate solutions to easily tote a diaper pail with them on the go and/or have multiple compact diaper pails throughout the house.

SUMMARY

A flexible diaper pail having a container that is adapted to stand upright. The container may have a flexible sheet, a cover, a base, a flap and an odor barrier. The cover may be attached to a first upper end of the flexible sheet, while the base may be attached to a second lower end of the flexible sheet. The cover may have a flap pivotably attached thereto, such that the flap is adapted to pivot between an open position and a closed position. The cover may further have an opening and an odor barrier disposed in the opening. The flexible diaper pail is adapted to compress to a very small volume and expand into a large container.

BRIEF DESCRIPTION OF THE DRAWINGS

Various exemplary embodiments of this disclosure will be described in detail, wherein like reference numerals refer to identical or similar components or steps, with reference to the following figures, wherein.

DETAILED DESCRIPTION

Particular embodiments of the present invention will now be described in greater detail with reference to the figures.

Figure 1:
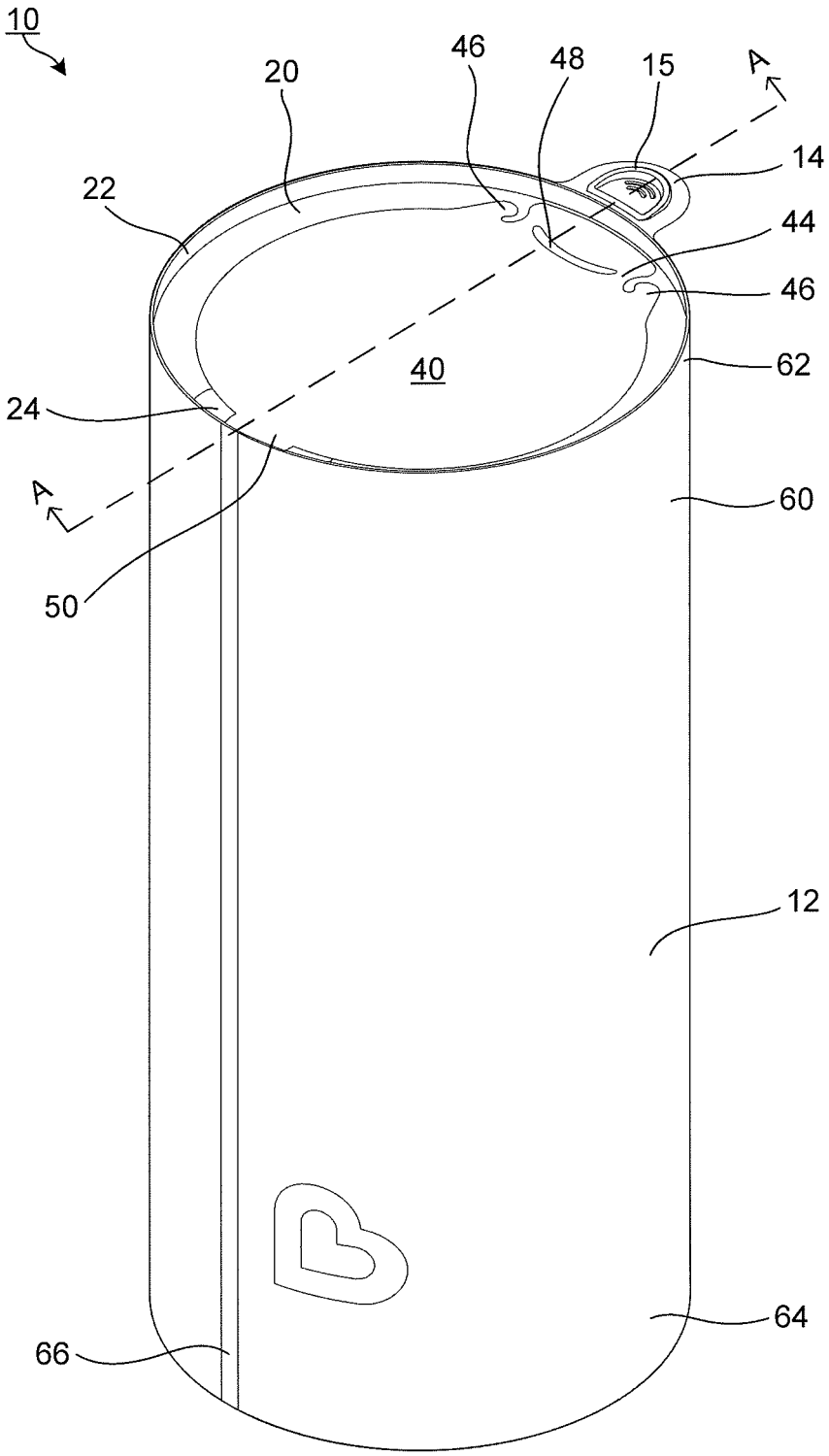
FIG. 1 illustrates a top perspective view of a flexible pail in a closed configuration according to the subject disclosure.

FIG. 1 illustrates a flexible pail 10 in a closed position adapted to stand upright. The flexible pail 10 may have a cover 20, a lid or flexible cover flap 40, a container body 60 and a base 80 (as shown in FIG. 3).

The flexible pail 10 can be sleek, compact and lightweight. Furthermore, the flexible pail 10 may be lower in cost and disposable. Therefore, the flexible pail 10 may be ideal for many different situations. For example, the lightweight and portable nature of the flexible pail 10 allows users to put the flexible pail in any given room and simultaneously provides users with the ability to bring the flexible pail 10 with them on the go. In other situations, parents may leave their children with grandparents or caretakers who may not have a traditional pail. The flexible pail 10 then would provide parents the simplicity and affordability of bringing the flexible pail 10 to the caretakers so that the caretakers need not suffer from the lack of an odor-proof diaper pail. Furthermore, the caretakers need not return the flexible pail 10 due to the affordability and disposability of the flexible pail 10.

Figure 2:
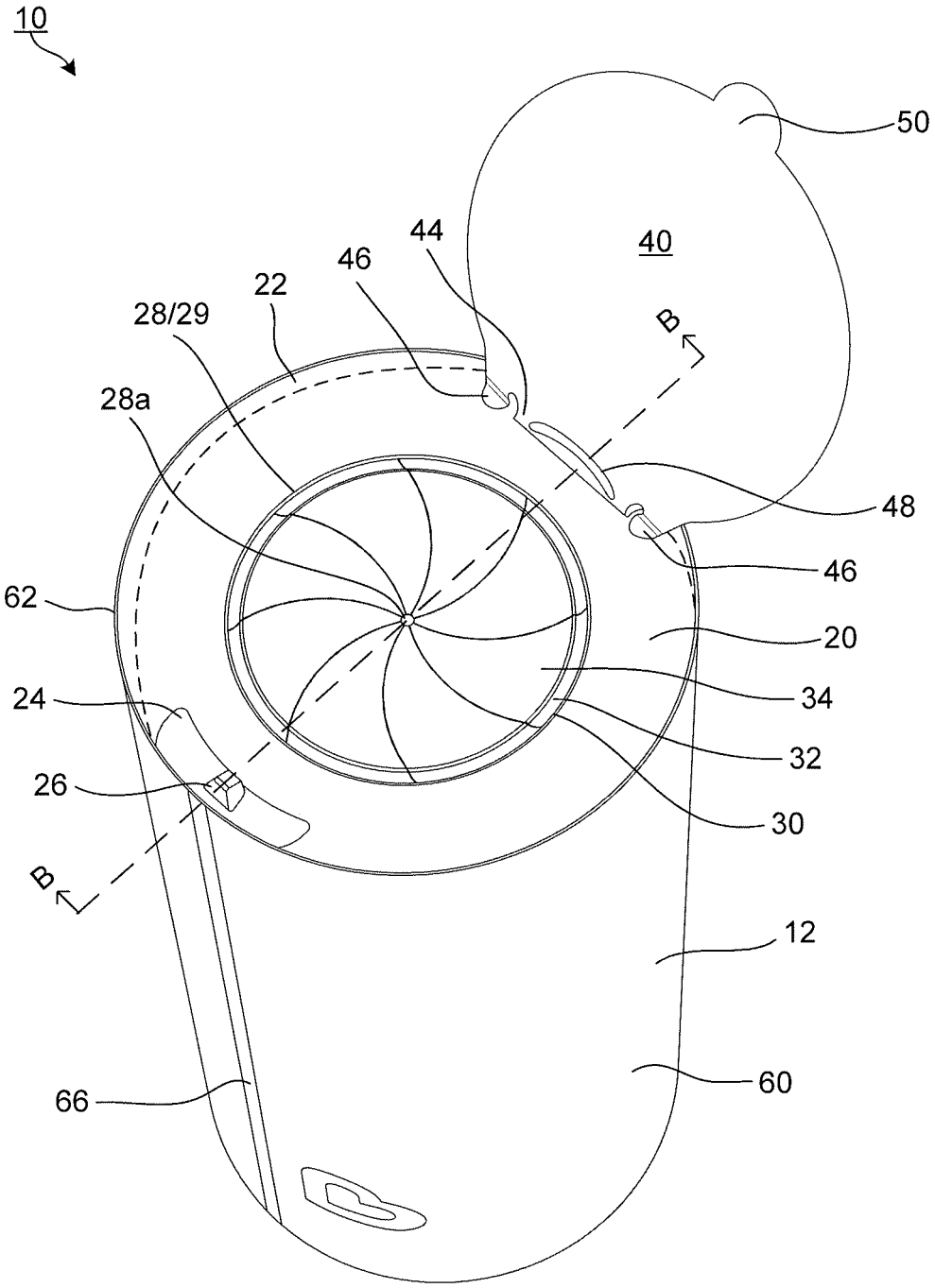
FIG. 2 is a top perspective view of the flexible pail in an open configuration.
Figure 3:
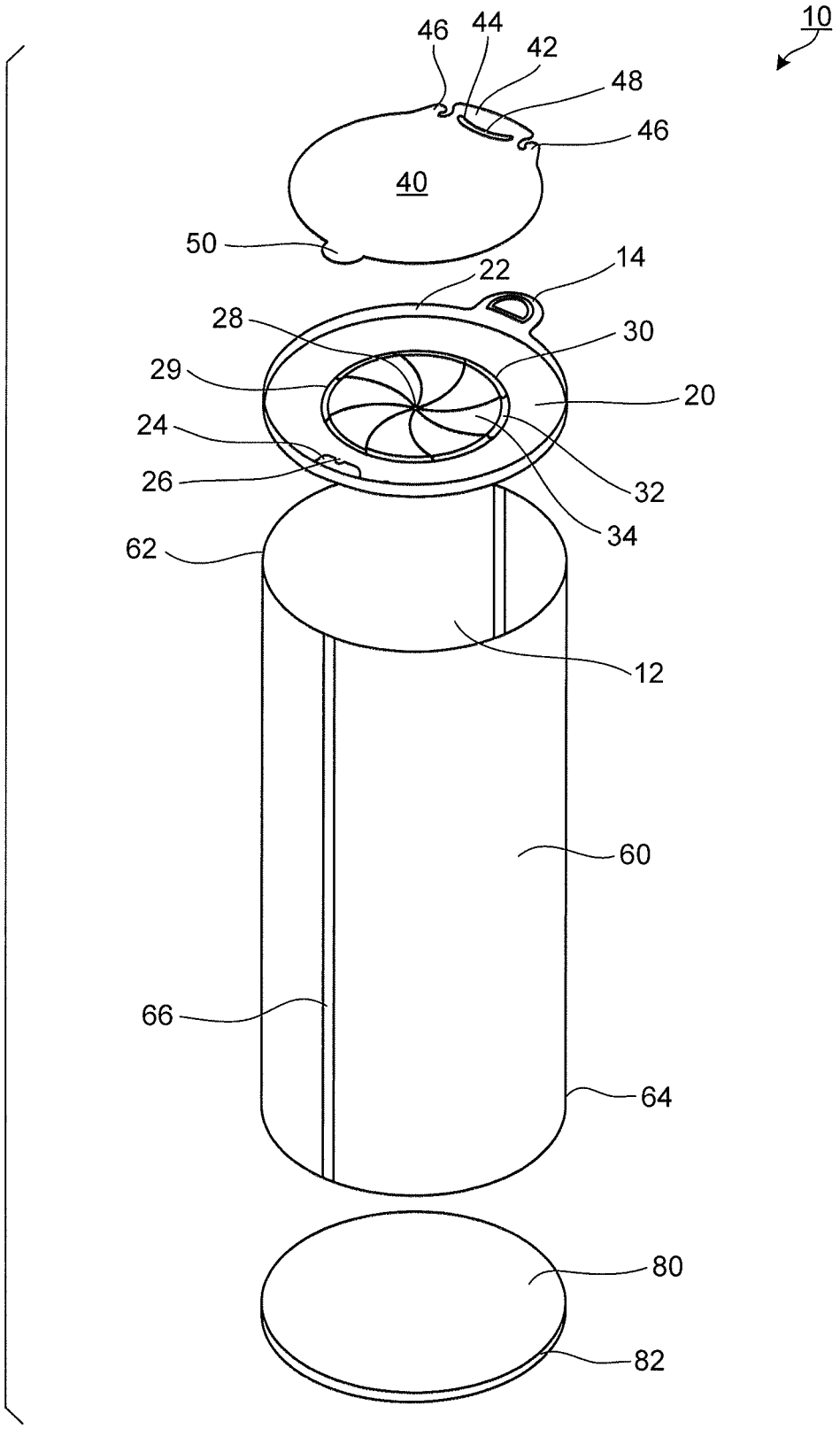
FIG. 3 is an exploded view of the flexible pail.

As further shown in FIGS. 1-3, the cover 20, the lid 40, the container body 60 and the base 80 work together to form a chamber 12, into which waste may be placed. The cover 20, the lid 40, the container body 60 and the base 80 also prevent waste odor from within the chamber or compartment 12 from reaching or emanating outside of the flexible pail 10. To achieve this, the cover 20 may be vacuum formed or bonded at a first upper end 62 of the container body 60. Similarly, the base 80 may also be vacuum formed at a second lower end 64 of the container body 60.

The cover 20 can be constructed or bonded by vacuum form or any other suitable method of manufacture for developing the semi-rigid cover 20. Furthermore, the cover 20 can be constructed of any suitable material that prevents unpleasant smelling odorous gases from leaking through the material of the flexible pail 10, including but not limited to polyethylene, plastics, rubber, metal, wood, thick fabrics and the like, which are capable of compressing into a compact flexible pail 10.

As shown in FIGS. 1-3 and 9-10, the cover 20 may have a cover lip 22. The cover lip 22 is disposed at distal edges of the cover 20 and can be used to attach the cover 20 to the first upper end 62 of the container body 60. Although shown as facing upwards and away from the container body 60, it is to be understood that the cover lip 22 may also be facing generally downwards and toward the container body 60 or any other suitable orientation that assists the cover 20 in attaching to the container body 60.

As stated above, the semi-rigid cover 20 is attached to the first upper end 62 of the container body 60. This can be achieved by using the cover lip 22 and applying a heat sealing process between the cover lip 22 and the first upper end 62. However, it is to be understood that the semi-rigid cover 20 may be fastened to the upper end 62 of the container body 60 in a variety of diverse ways, such as but not limited to, an adhesive, a bonding agent, material welding, an/or any other suitable method for attaching the cover 20 to the upper end of the container body 60.

Figure 9:
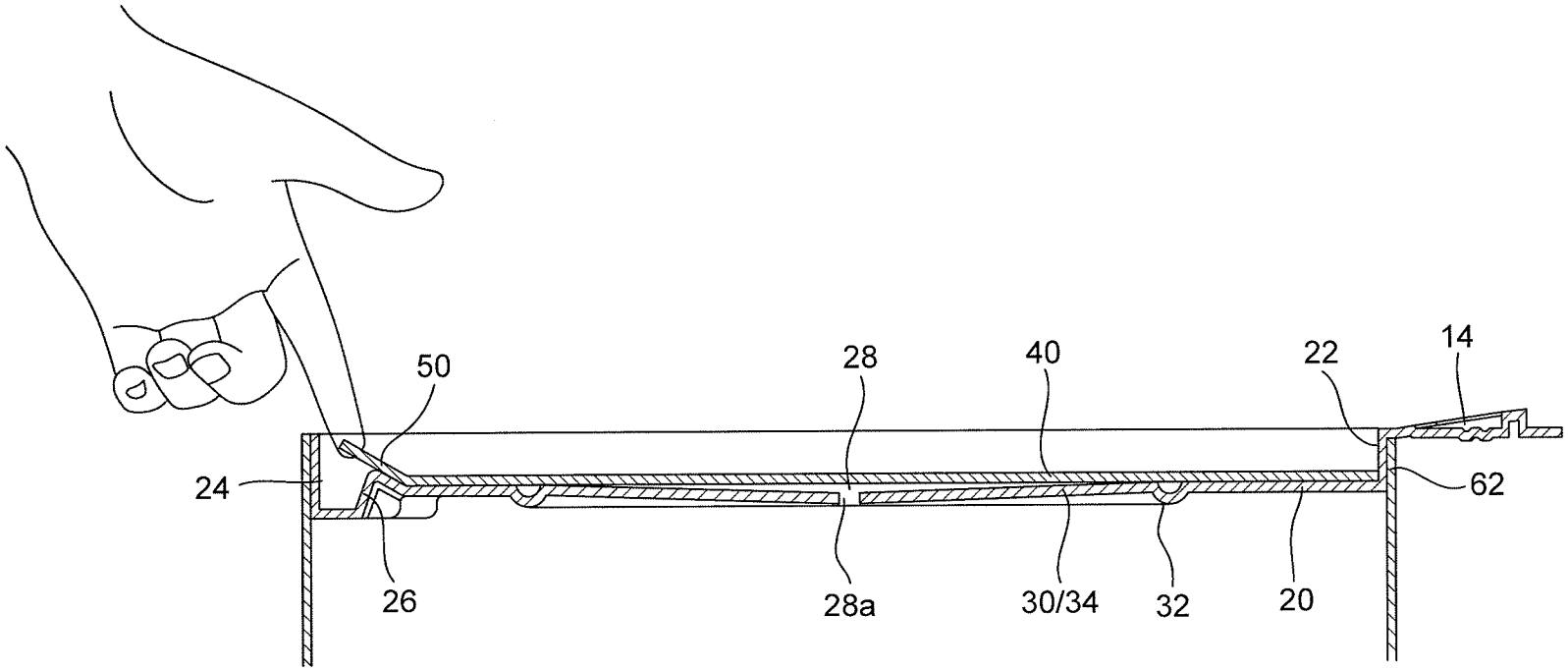
FIG. 9 is a partial cross-section view along A-A in FIG. 1 of the flexible pail in the closed configuration.
Figure 9A:
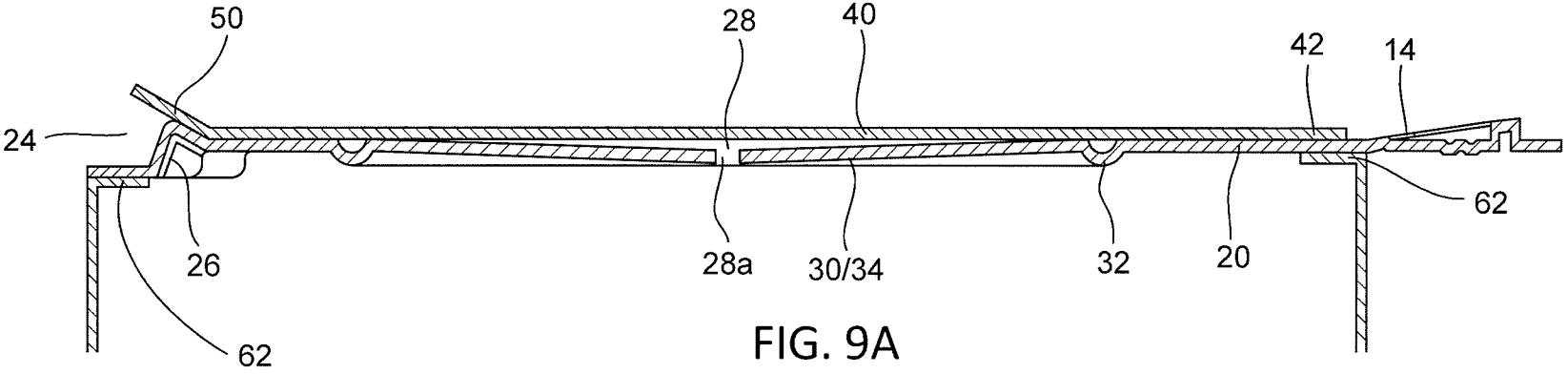
FIG. 9A is a partial cross-section view of the flexible pail without a cover lip.
Figure 9B:
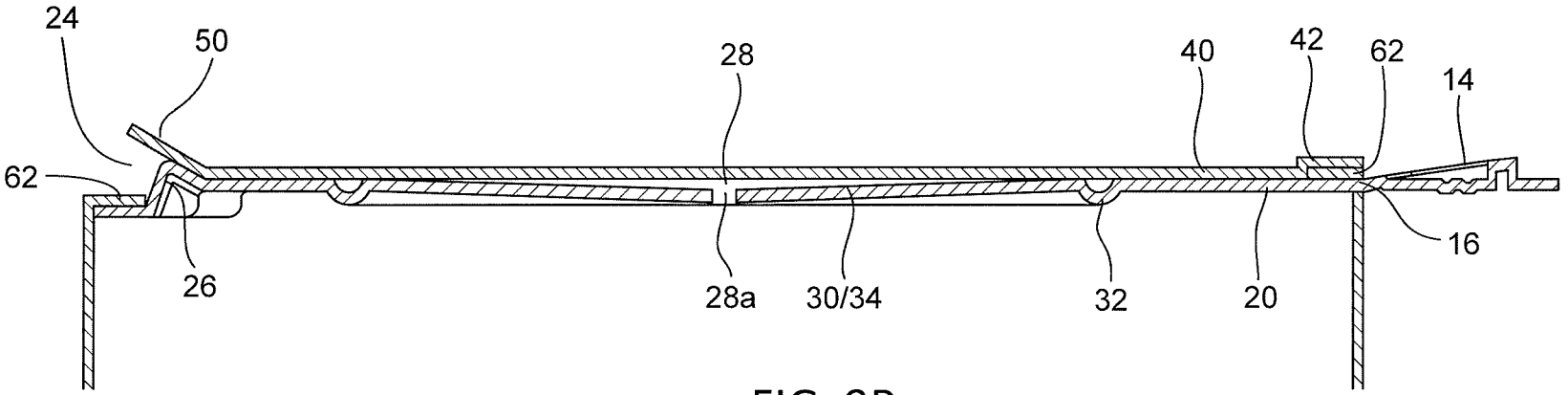
FIG. 9B is a partial cross-section view of a second configuration of the flexible pail without a cover lip.

FIGS. 9A-9B contemplate that the cover 20 need not have cover lip 22 to be attached to the first upper end 62 of the container body 60. As shown, the first upper end 62 of the container body 60 may sit below (FIG. 9A) or above (FIG. 9B) the cover 20 and be bonded to distal edges of the cover 20. FIG. 9B further contemplates that the first upper end 62 may have a hole 16 through which a tab 14 may sit therethrough. The removal of the cover lip 22 allows for the flexible pail 10 to compress into a smaller unit. In both instances, the first upper end 62 of the container body 60 may be formed into a plurality of inward facing tabs so that they may be folded inwards without overlapping and be directly bonded to the cover 20.

FIGS. 1-3 and 9-10 illustrate the cover 20 may further have a finger recess 24 that allows a user to more easily remove the lid 40. Similarly, multiple finger recesses 24 can be designed onto the cover 20 such that the user may easily remove the lid 40 from the cover 20. It is to be understood that the finger recess 24 can be sized and positioned in any suitable shape, size and/or orientation that allows a user to easily remove the lid 40 from the cover 20.

FIGS. 1-3 and 9-10 show the cover 20 may further have a cover bump or protrusion 26 that may be slightly raised or elevated above the surface of the cover 20. The cover protrusion 26 provides a similar function as the finger recess 24. In other words, the cover protrusion 26 assists a user in easily removing the flap 40 from the cover 20 by slightly raising the flap to above the cover 20. Although shown disposed within the finger recess 24, it is to be understood that the cover protrusion 26 may be disposed on any suitable surface of the cover 20 to allow a user to easily grasp the flap 40 and remove it from the cover 20. Similarly, the protrusion 26 may be of any suitable shape, size and/or orientation that allows the user to easily remove the flap 40 from the cover 20.

FIGS. 2-3 and 9-10 show that the semi-rigid cover 20 has an opening 28 adapted to receive waste therein. The opening 28 may be positioned centrally in the cover 20 such that waste or other material moving through the opening 28 moves from outside of the flexible pail 10 to the inner storage compartment 12 inside of the flexible pail 10. More specifically, the material moving through the opening 28 may be deposited into the chamber 12.

FIGS. 2-3 and 9-10 demonstrate that the opening 28 may be configured to include a barrier 30 to help keep the odor within the compartment 12 and prevent the odor from reaching the outside of the flexible pail 10. The barrier may be made of a similar material as the cover 20, or a different material for a different level of flexibility.

The barrier 30 may have a finger or plurality of fingers 34 that, in a first position, restrict the total open area of the opening 28 to form a smaller opening 28*a*, through which material and malodor may pass through. The plurality of fingers 34 extend radially inward from an edge 29 of the opening 28 to the smaller opening 28*a* at approximately a center of the opening 28.

Figure 10:
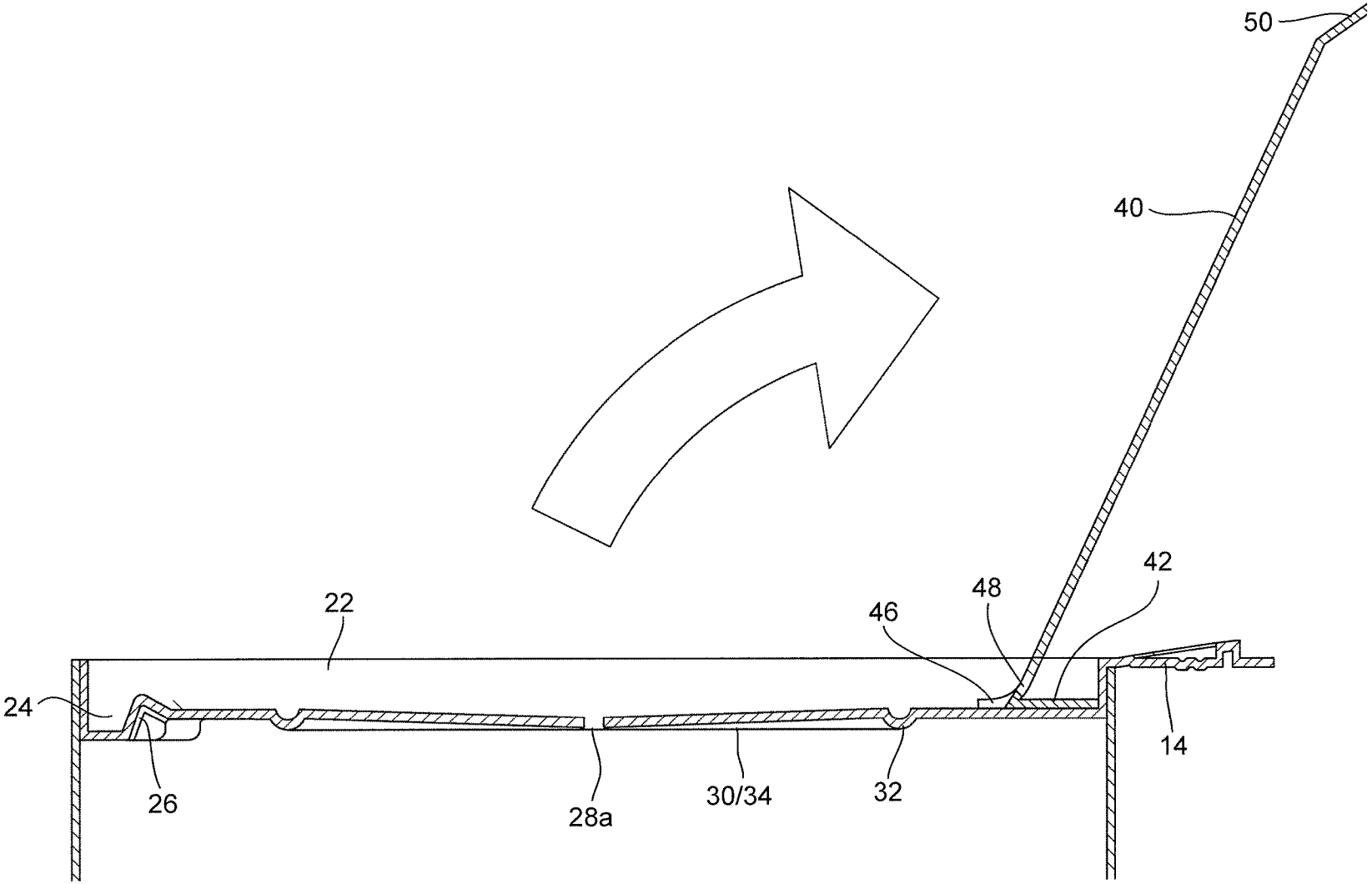
FIG. 10 is a partial cross-section view along B-B in FIB. 1 of the flexible pail in the open configuration.

FIG. 10 shows the addition of a finger recess 32 in the barrier 30. This barrier recess 32 allows for additional flexibility of the barrier 30 so that a user may more easily push through the barrier 30 to deposit waste into the compartment 12. The barrier recess 32 may be disposed on the plurality of fingers 34 of the barrier 30. The barrier recess 32 adds strength and flexibility to the fingers 34 of the barrier 30. The barrier recess 32 or curve allows the fingers 34 to resiliently withstand more repetitive use across the barrier 30. The barrier recess 32 may also act as a spring to bias the barrier fingers 34 back upright into its original closed position after each use.

FIGS. 1-3 and 6-7 contemplate the cover 20 having the cover flap 40 attached. The flap 40 may be pivotally attached over the opening 28 in the cover 20. More specifically, the flap 40 may have a base 42 that is attached to the cover 20.

The flexible cover flap 40 on the semi-rigid cover 20 may be adapted to close over the opening when not in use. The flexible flap 40 may further have a resealable adhesive adapted to seal odor from the waste escaping through the opening 28 in the closed and sealed position. The resealable adhesive allows for the flap 40 to pivot between the closed and open positions. Although described with a resealable adhesive, it is to be understood that various other suitable methods may be provided to seal the cover 20 and flap 40 and malodor from escaping through the opening 28 and the flap 40 according to this disclosure.

Operation of the cover flap 40 may be performed by a one-handed operation. In use, the cover flap 40 is pulled away from the opening 28 and a waste item is placed through the opening 28. The cover flap 40 may flexibly allow the waste item to be inserted through the opening 28. The user may then remove their hand from the cover flap 40 disposed over the opening 28. The cover flap 40 is then closed and the adhesive located between the cover flap 40 and the cover 20 seal the cover flap 40 and the cover 20 to each other to form a tight seal to prevent unpleasant odors from escaping from within the compartment 12 of the flexible pail 10.

To facilitate the opening and closing of the flap 40, the flap 40 may also have a hinge 44 capable of holding itself in an open position, such that items can be inserted by a user into the opening 28 without interruption by the flap 40. The flexible cover flap 40 pivots about one side of the opening 28. However, it is to be understood that the flap 40 can be constructed in a variety of different methods, such as multiple flaps 40 that cover each other, each flap pivoting about a different side of the opening 28.

Referring back to FIGS. 2-3, the hinge 44 provides an axis, about which the flap pivots. Along the axis, the flap 40 may have a hinge aperture 48, which allows for greater flexibility of the flap 40. Furthermore, the aperture 48 allows for more surface area for the flap base 42 to attach to the cover 20. Due to the lack of material in the aperture 48, the flap 40 may then more easily pivot between the open and closed positions. Although not shown, it is further contemplated that a thinner portion can achieve a similar easing for the pivoting motion.

FIGS. 2 and 10 show that the hinge 44 of the flexible cover flap 40 may be cut to form geometric protrusions or feet 46, which provide support for the flexible cover flap 40 to remain in the open position. When the flexible cover flap 40 is opened, the geometric protrusions 46 are flipped forward and biased against a top surface of the cover 20, allowing the flexible cover flap 40 to remain open. The open position then allows a user to insert items into the opening 28 without interruption by the cover flap 40.

When a user desires the flexible cover flap 40 to be closed, the geometric protrusions 46 are flipped forward, acting as legs that are pressed against the top surface of the cover 20 until enough closing force is applied to the cover flap 40 for the geometric protrusions 46 to slide against the cover 20 and flip backwards to release the feet 46 and permit the cover flap 40 to pivot into the closed position of FIGS. 1 and 9.

To further assist opening and closing the flap 40, the flexible flap 40 may have a pull tab 50 to allow a user to easily open and close a flexible cover flap 40. More specifically, the tab 50 is constructed into the cover flap 40 to assist in pulling the cover flap away from the cover 20 to permit access to the opening 28. The tab 50 may also be angled upwards, as shown in FIGS. 9-10 for easier access thereto.

Figure 6:
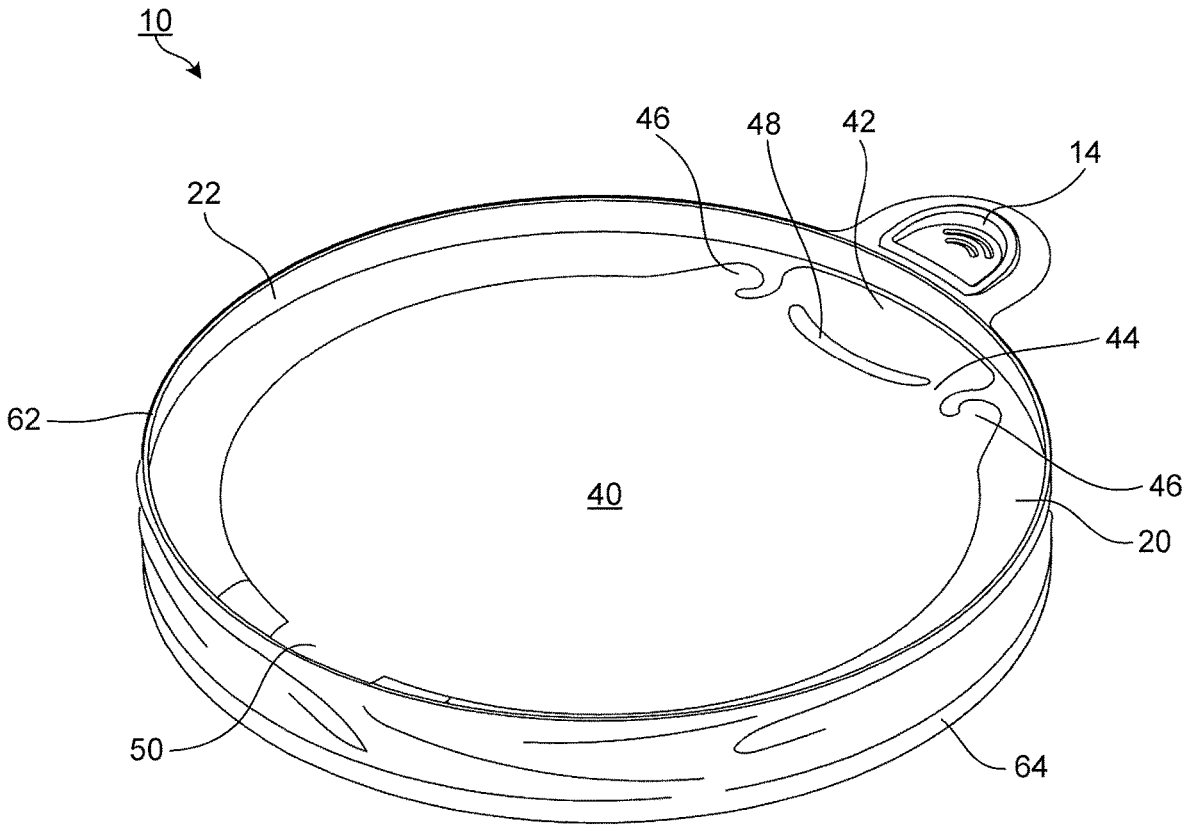
FIG. 6 is an upper perspective view of the flexible pail in a compact, compressed configuration.
Figure 7:
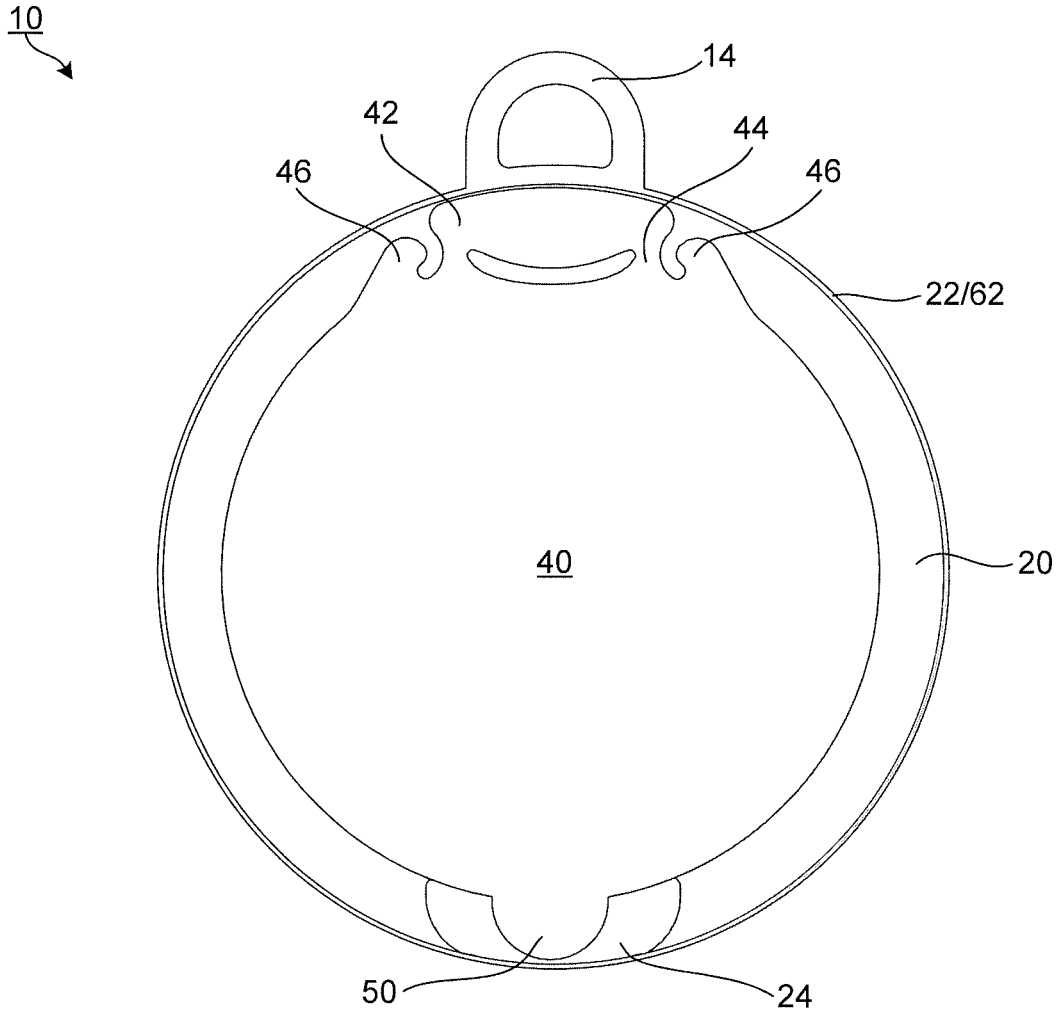
FIG. 7 is a top view of the flexible pail.

FIGS. 1-3 and 6 show the cover 20 is attached to the upper end 62 of the container body 60. The container body 60 is made from a flexible sheet having a generally cylindrical form. The flexible sheet of the container may be composed of a semi-rigid material capable of being stretched into an upright standing position (FIGS. 1-3) and/or compressed flat for storage (FIG. 6). For example, the flexible pail 10 can be compressed to a height of less than approximately one eighth (⅛) of an inch or fully extended to a height of 18 inches or more. The maximum height of the flexible pail 10 can be chosen by how much waste is desired to be placed in the compartment 12. For example, a height of approximately 18 inches can accommodate approximately 30 used newborn diapers. The height range provides users with the flexibility of using the flexible pail 10 for as little as a single day or as long as one week. In other words, the height range of the flexible pail 10 provides an adaptable compartment 12, the volume of which varies with the height range. The changing volume or adaptable compartment 12 is able to accommodate as much or as little waste as the user desires until the compartment is full.

Various materials may be selected according to this subject disclosure in order to yield the container body 60. Semi-rigid materials may be used to provide sufficient rigidity to keep the flexible pail 10 in an upright orientation during use and storage. The material selected may also be odor resistant. Deodorizers may be incorporated into this subject disclosure to prevent foul odors from emanating from within the flexible pail 10.

Figure 4:
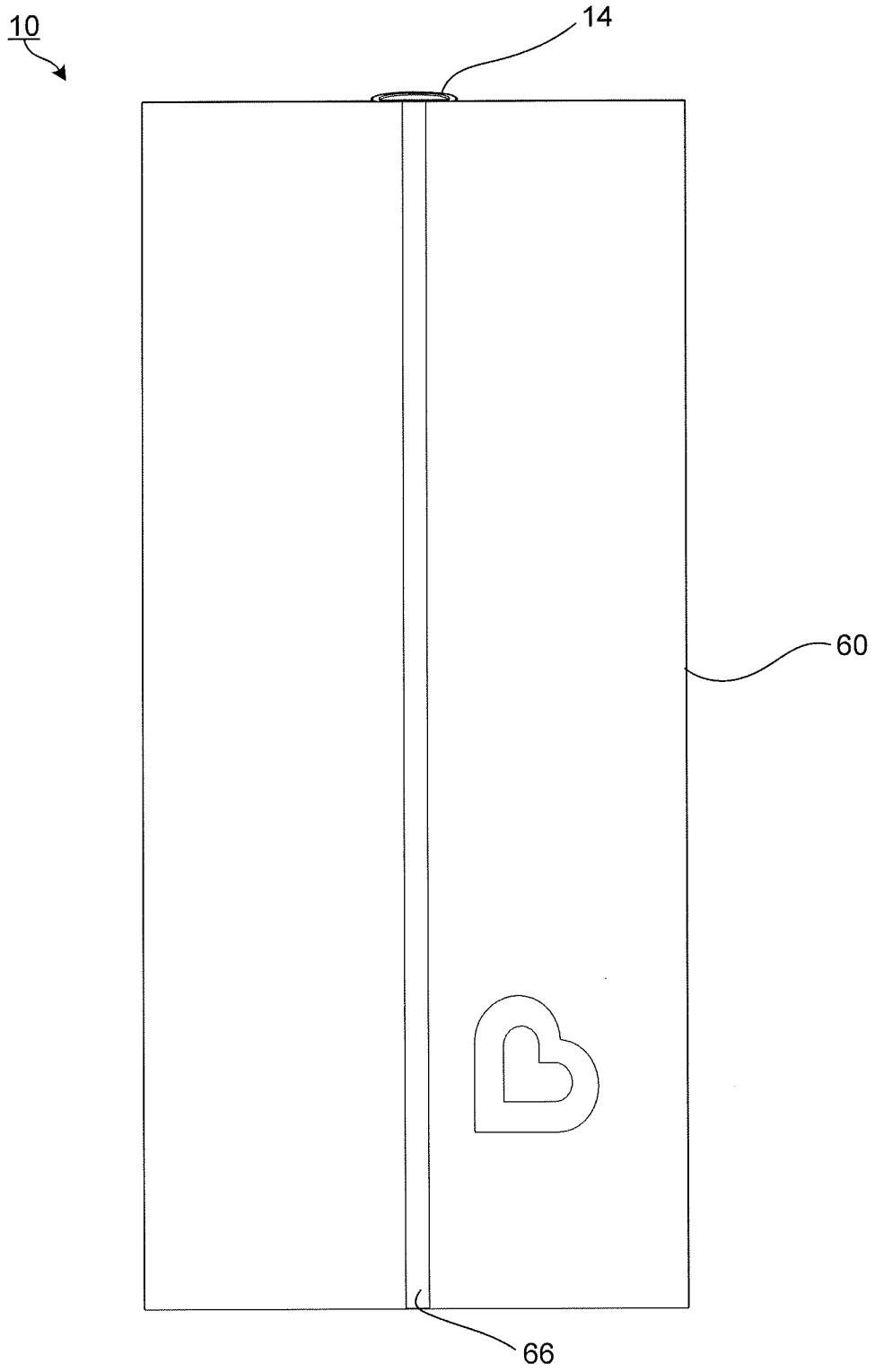
FIG. 4 is a front view of the flexible pail.
Figure 5:
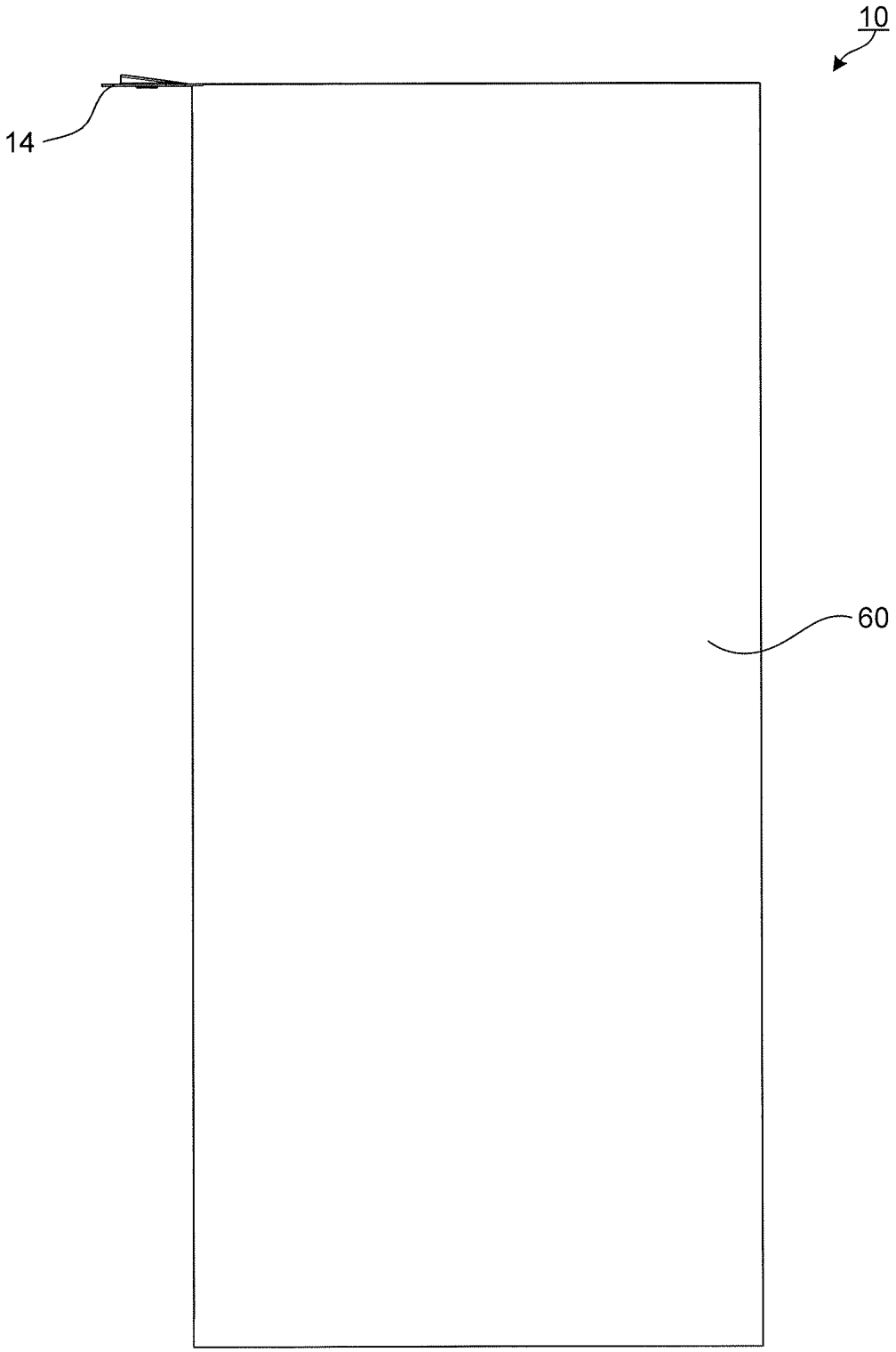
FIG. 5 is a side view of the flexible pail.

FIGS. 3-4 illustrate a transparent line 66 in the container body 60 along a portion or entirety of a length of the container body 60. The transparent line 66 allows a user to view and/or plan for the amount of space already used and the remaining capacity within.

The container body 60 may take a variety of different shapes. Although, embodied herein in cylindrical form, the container body 60 can take any suitable shape, such as a rectangular prism or any obtuse shape. Accordingly, the semi-rigid cover 20 and base 80 may have a complementary shape.

Figure 8:
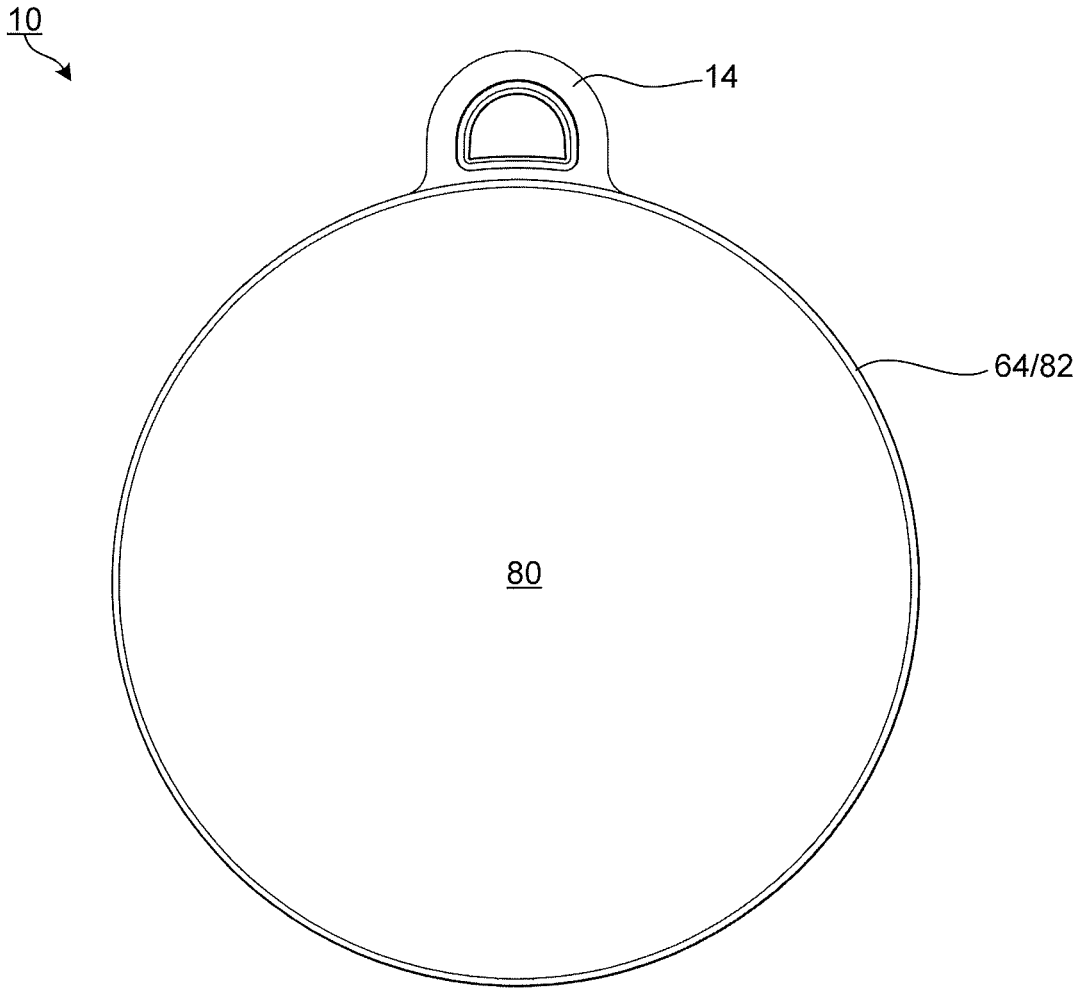
FIG. 8 is a bottom view of the flexible pail.

FIGS. 3 and 8 show that the base 80 is attached to the lower end 64 of the container body 60. Like, the attachment of the cover 20 to the upper end 62 of the container body 60, the same method of attachment is possible for the semi-rigid base 80 and the lower end 64 of the container body 60. That is, the base 80 may have a similar base lip 82. A similar heat sealing process discussed above may be applied between the base lip 82 and the second lower end 64. However, it is to be understood that the base 80 may be fastened to the lower end 64 of the container body 60 in a variety of diverse ways, such as but not limited to, an adhesive, a bonding agent, material welding, an/or any other suitable method for attaching the cover 20 to the upper end of the flexible sheet.

Like the cover 20, the base 80 need not have a base lip 82 that bonds to the second lower end 64. It is contemplated that the second lower end 64 of the container body 60 may be bonded directly onto the base 80. The second lower end 64 of the container body 60 may be formed into a plurality of inward facing tabs so that they may be folded inwards without overlapping and be directly bonded to the base 80. The removal of the base lip 82 would allow for the flexible pail 10 to compress into a smaller unit.

Other additions to the flexible pail 10 are also disclosed herein. For example, the flexible pail 10 may also have a loop or tab 14 disposed thereon to hang. As shown in FIGS. 6-12, the loop or tab 14 may be molded along with the cover 20. However, it is to be understood that the loop 14 may be attached anywhere in the flexible pail 10 to provide a location to hang the flexible pail 10. For example, the loop 14 may be constructed into the container body 60. Ultimately, the loop 14 provides a user with the ability to hang the flexible pail 10 in a convenient location. Similarly, the loop or tab 14 may also be used as a handle when transporting the flexible pail from one location to another location. It is also contemplated that multiple loops or tabs 14 are provided to be used as handles and/or hanging points. Although not shown, a hook may fulfill a similar function for the loops or tabs 14.

When the flexible pail 10 has a tab 14, the tabs 14 may have recesses or grooves 15 to provide additional tactile surfaces for better grip. The usage of the recesses 15 may also double as holding points for wide hooks that may fit therein.

Figure 11:
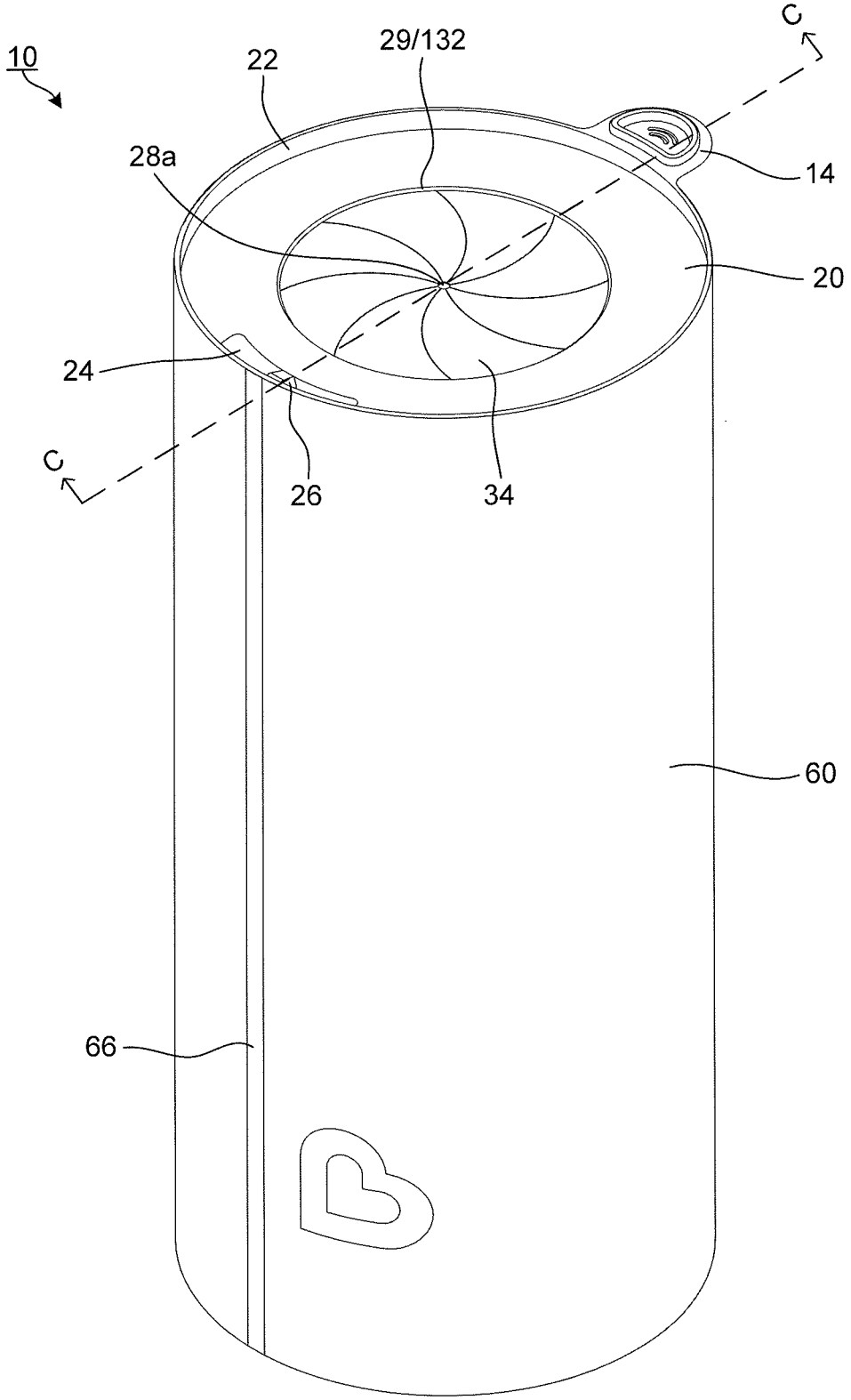
FIG. 11 is an upper perspective view of a second embodiment of the flexible pail without a cover flap shown.
Figure 12:
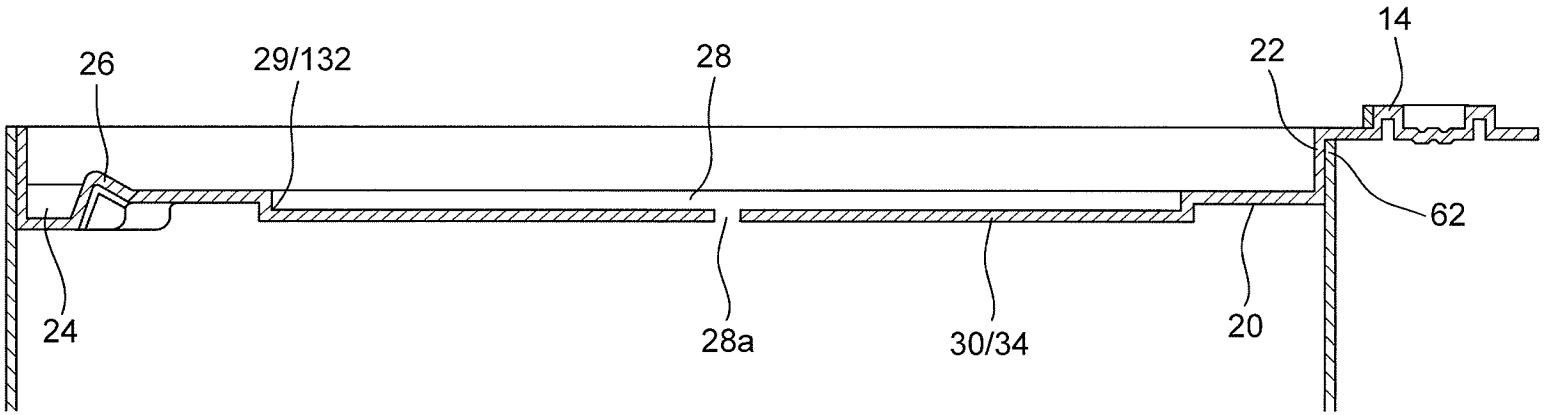
FIG. 12 is a partial cross-section view along C-C of FIG. 11.

FIGS. 11-12 contemplates a barrier shoulder 132 disposed at the edge 29 of the opening 28, where the barrier 30 begins. The barrier shoulder 132 similarly provides additional flexibility of the barrier 30 so that a user may more easily push through the barrier 30 to deposit waste into the compartment 12. The step in the barrier shoulder 132 adds to the strength of the barrier 30 and prevents degradation of the barrier 30 due to the repetitive movement of the barrier fingers 34.

Figure 13:
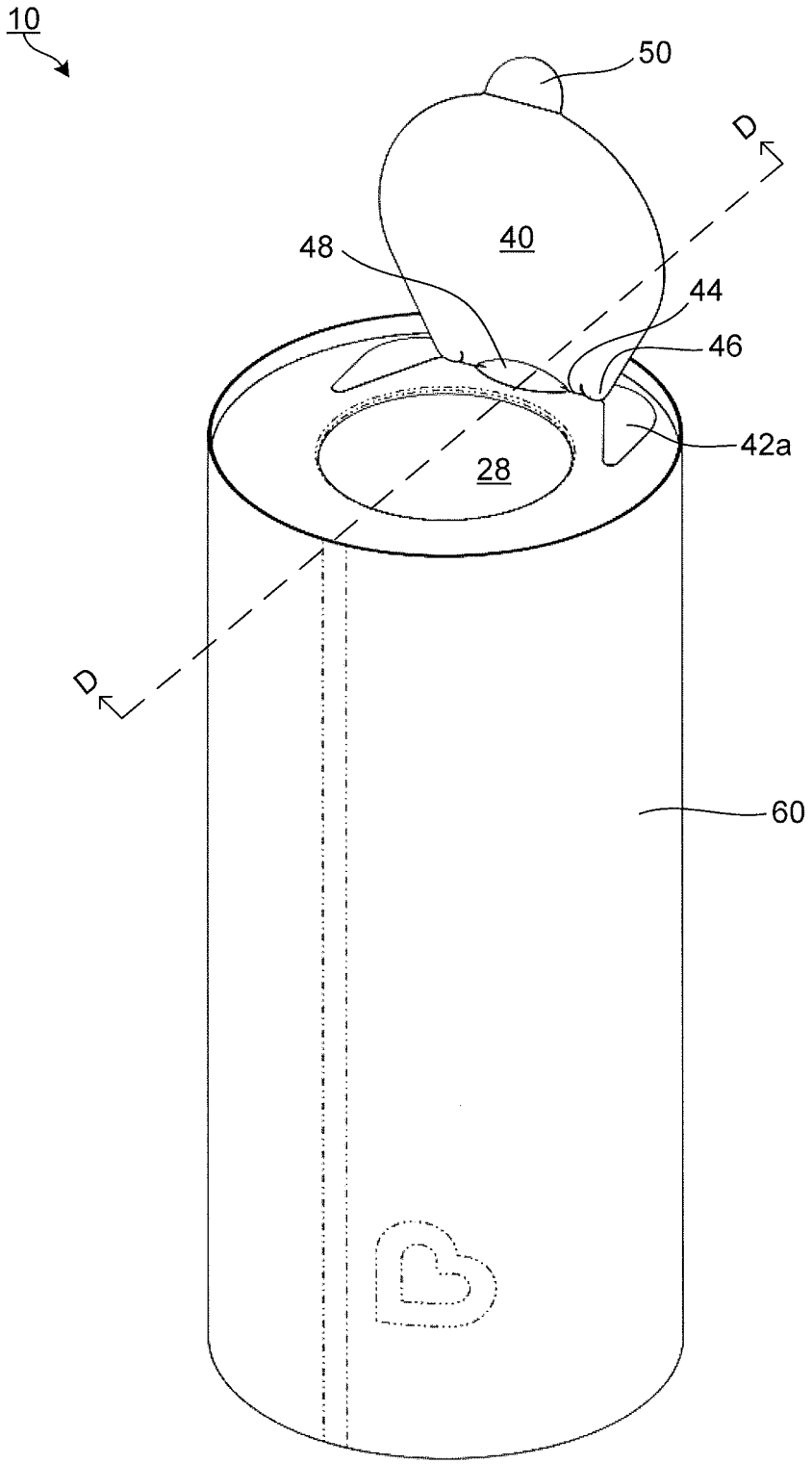
FIG. 13 is an upper perspective view of a third embodiment of the flexible pail.
Figure 14:
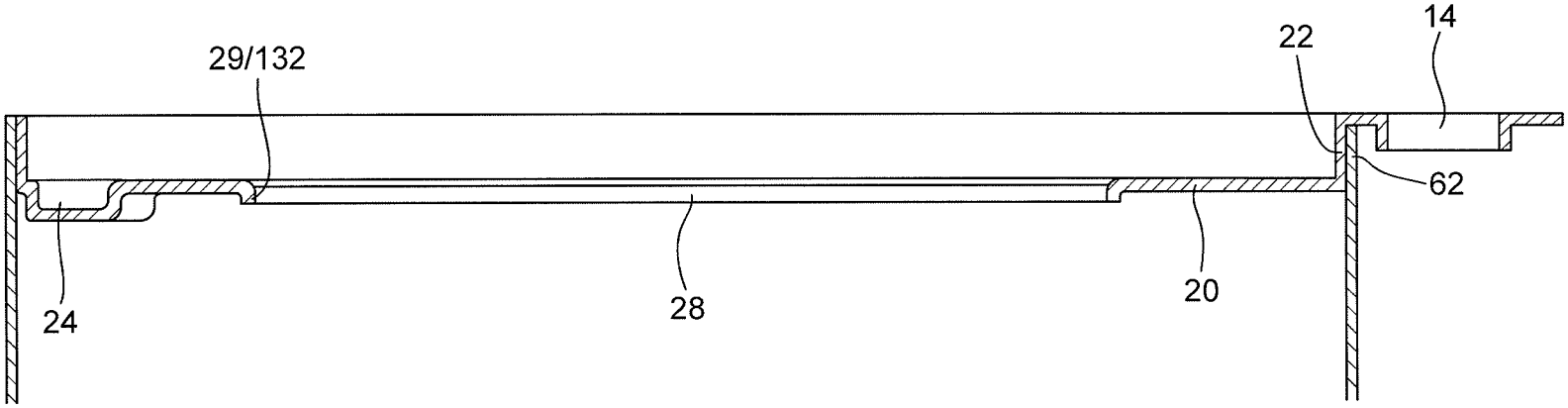
FIG. 14 is a partial cross-section view along D-D of FIG. 13 without a cover flap.

FIGS. 13-14 demonstrate that the flexible pail 10 need not have a barrier 30. By removing that element, the flexible pail 10 would have a larger opening 28, which provides easier access to place waste therethrough.

FIGS. 13-14 further contemplate the flap 40 covering the opening 28 that has base extensions **42*a*. The base extensions 42*a* help prevent the cover flap 40 from peeling off by providing additional surface area for the flap base 40 to bond to the cover 20**.

Figure 15:
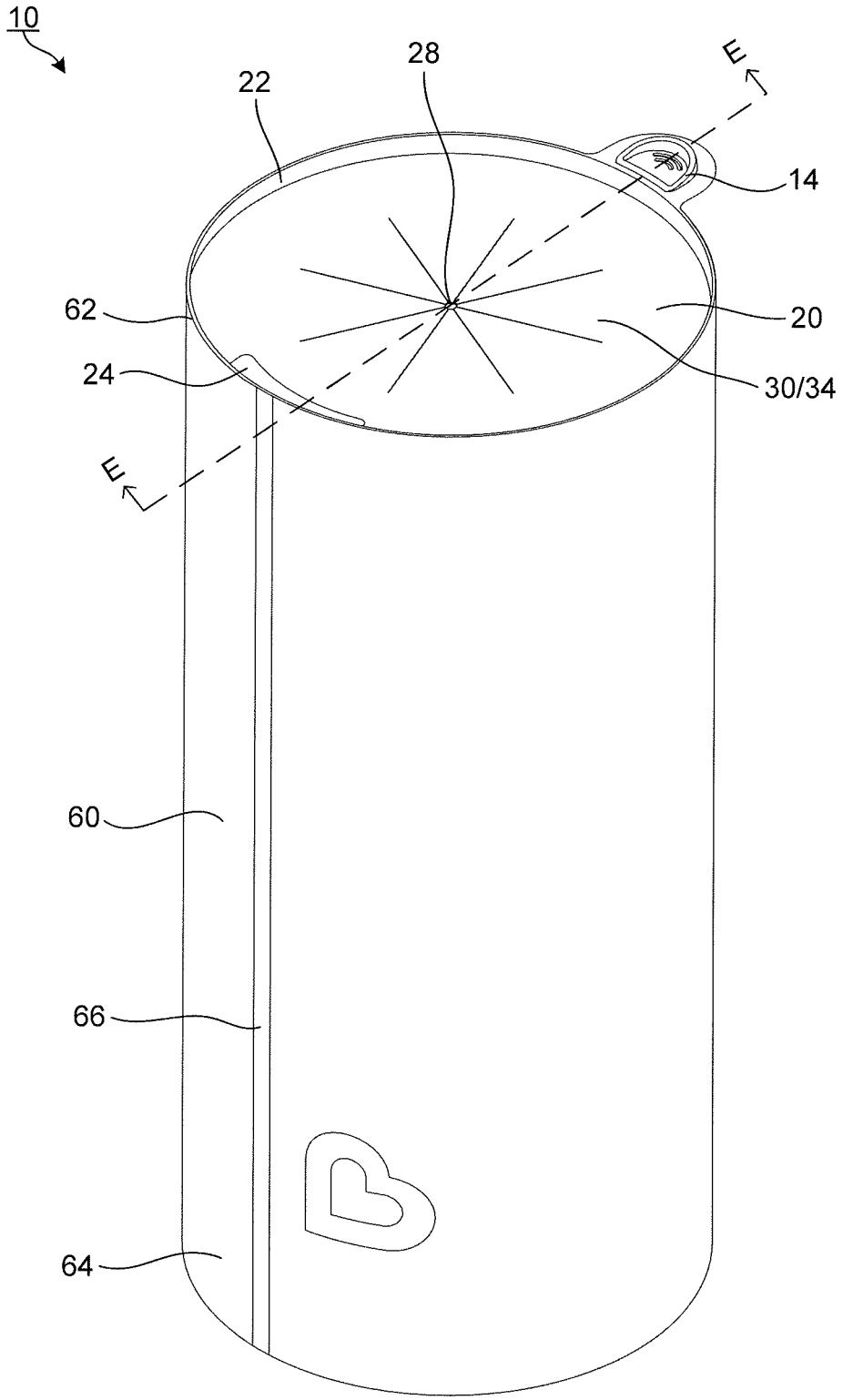
FIG. 15 is an upper perspective view of a fourth embodiment of the flexible pail.
Figure 16:
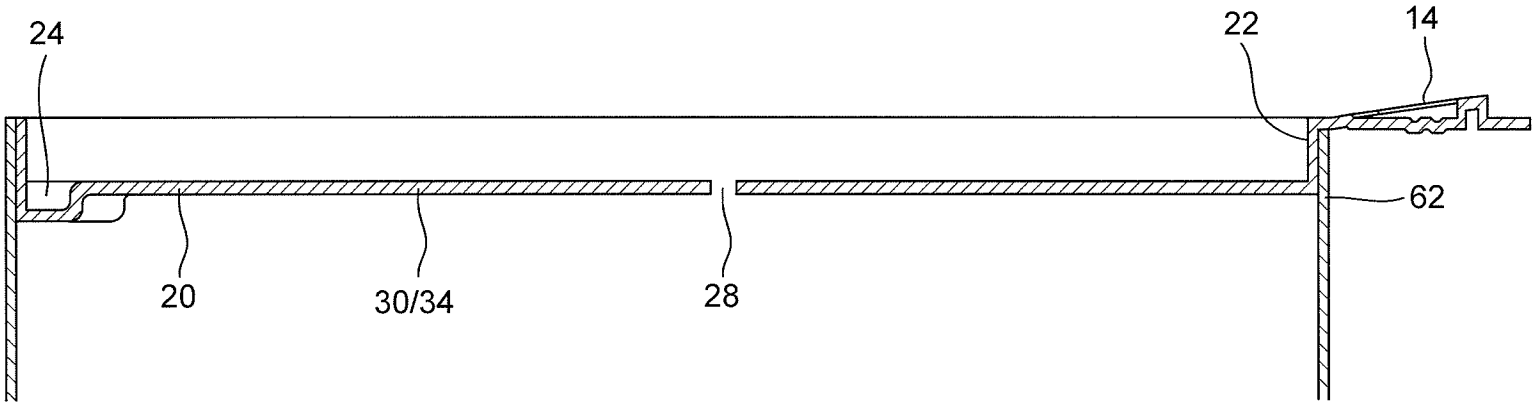
FIG. 16 is a partial cross-section view along E-E of FIG. 15.

FIGS. 15-16 show the flexible pail 10 having the barrier 30 without a recess 32 or shoulder 132. The lack thereof provides more rigidity to the barrier 30 of the flexible pail 10, which would also enhance the flexible pail 10 by lowering the likelihood of the fingers 34 sagging or drooping. Furthermore, the increased rigidity would prevent unwanted or accidental access to the barrier 30 from depressing the fingers 34 and releasing the odor therethrough.

Figure 17:
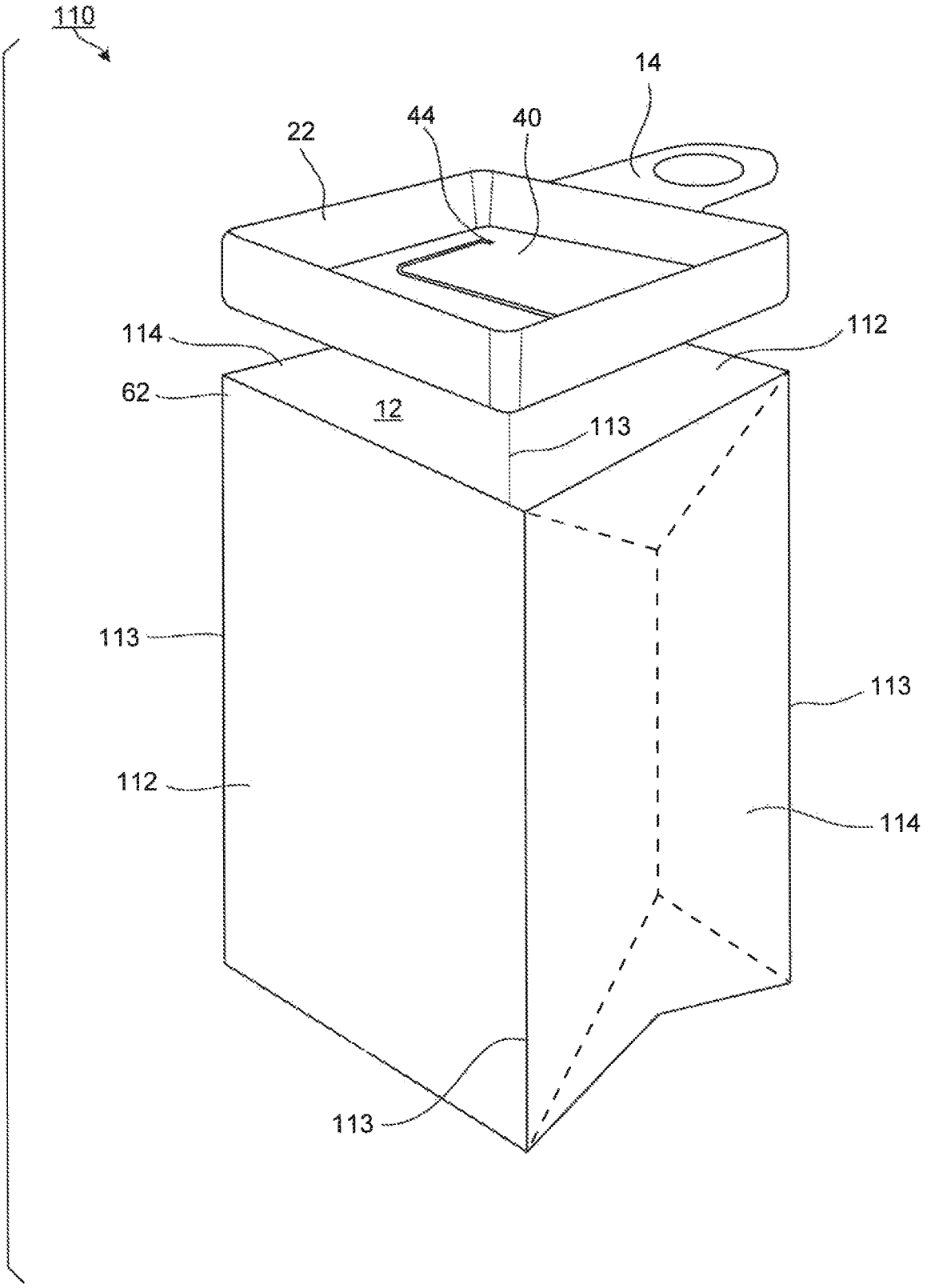
FIG. 17 is an exploded view of a fourth embodiment of the flexible pail.

FIG. 17 shows a rectangular flexible pail 110 according to this subject disclosure. The rectangular shape promotes more volume and a wide base to hold the flexible pail 10 upright. Furthermore, this shape may provide further support to allow the rectangular flexible pail 110 to stand straight upright due to different panels 112, 114 being melded together to create edges 113, which are able to withstand and support the overall shape of the rectangular flexible pail 110. However, it is to be understood that the flexible pails 10, 110 may take any shape or size that accomplishes the task of holding material within. For example, a generally cylindrical shape as disclosed above may also hold material within. Similarly, the generally cylindrical shape would be able to stand upright in addition to holding material within because the downwards weight of the flexible pail would be distributed evenly throughout the side surface of the cylindrical shape.

Figure 18:
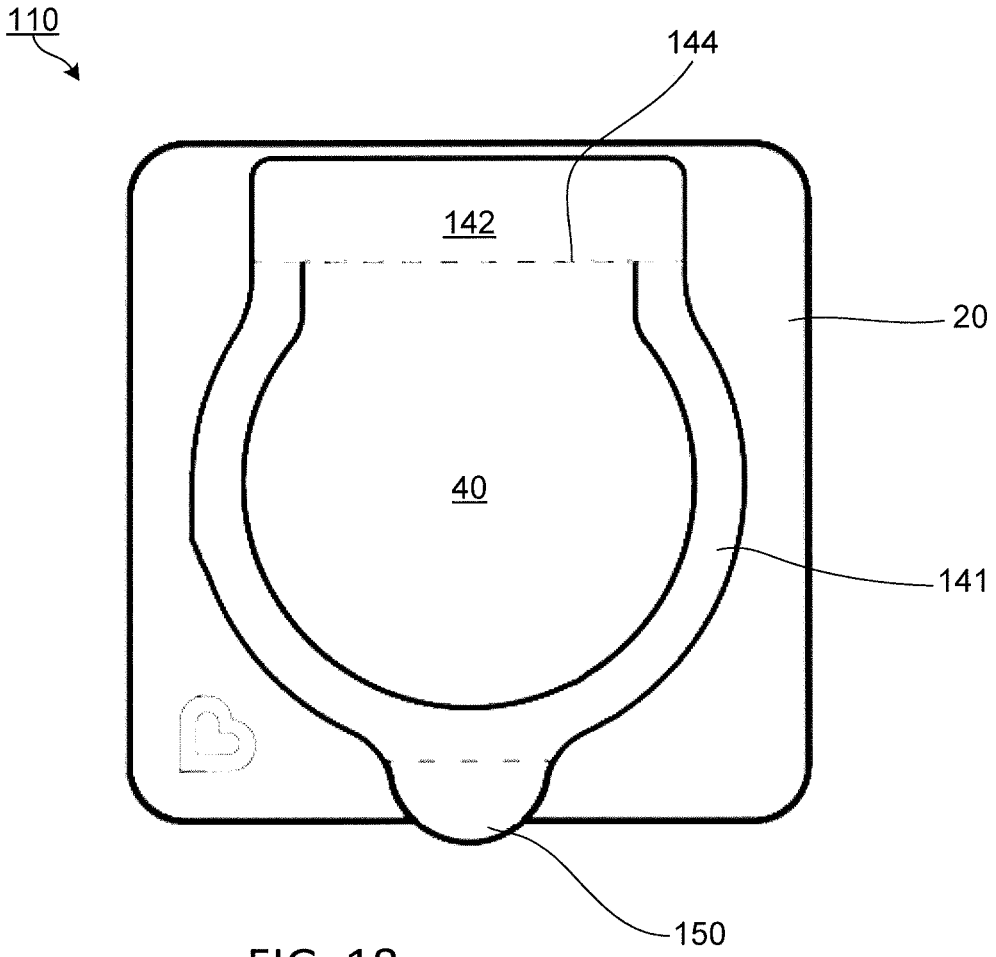
FIG. 18 is a top view of a fifth embodiment of the flexible pail.

FIG. 18 shows the rectangular flexible pail 110 with another embodiment of the flexible cover flap 40 hinged at an base extended base 142, which is attached to the cover 20. The flexible cover flap 40 may have the extended base 142, which would prevent the cover flap from peeling off by providing additional surface area for the adhesive to adhere to. There may also be a transparent resealable adhesive sheet 141 that helps provide a method to secure the cover flap. The hinge may also have a geometric diecut 144 to allow the cover flap to stay open. The geometric diecut 144 may also be added to the transparent adhesive 141 to prevent the transparent adhesive sheet 141 from blocking the hinge 44 or vice versa. The flexible cover flap 40 may also have a tab 150 for a user to easily open and close the cover flap.

Figure 20:
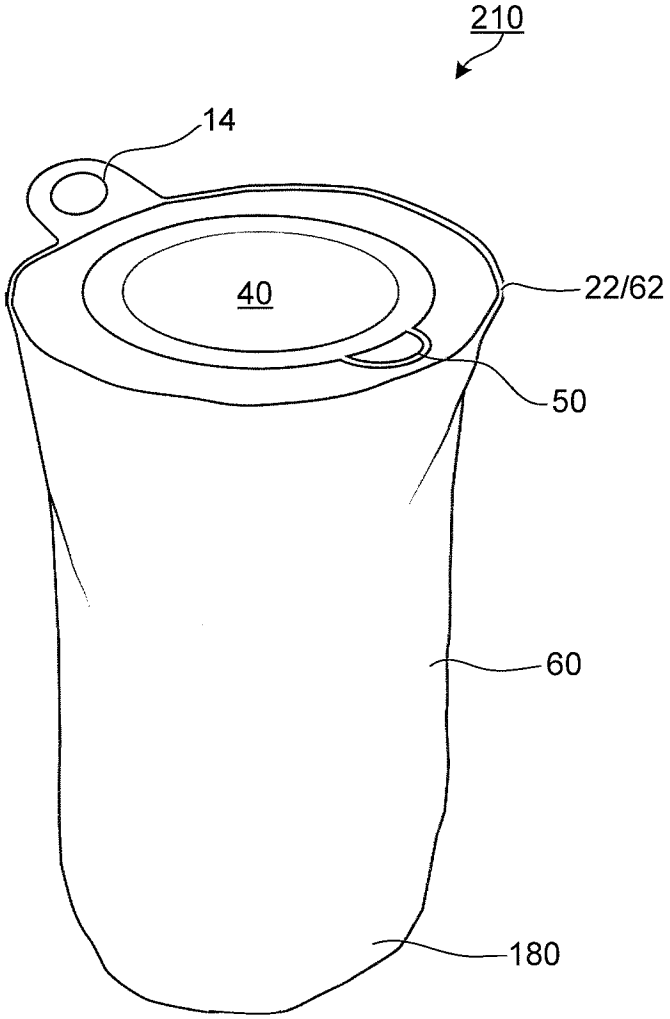
FIG. 20 is an upper perspective view of FIG. 19 in a closed position.
Figure 19:
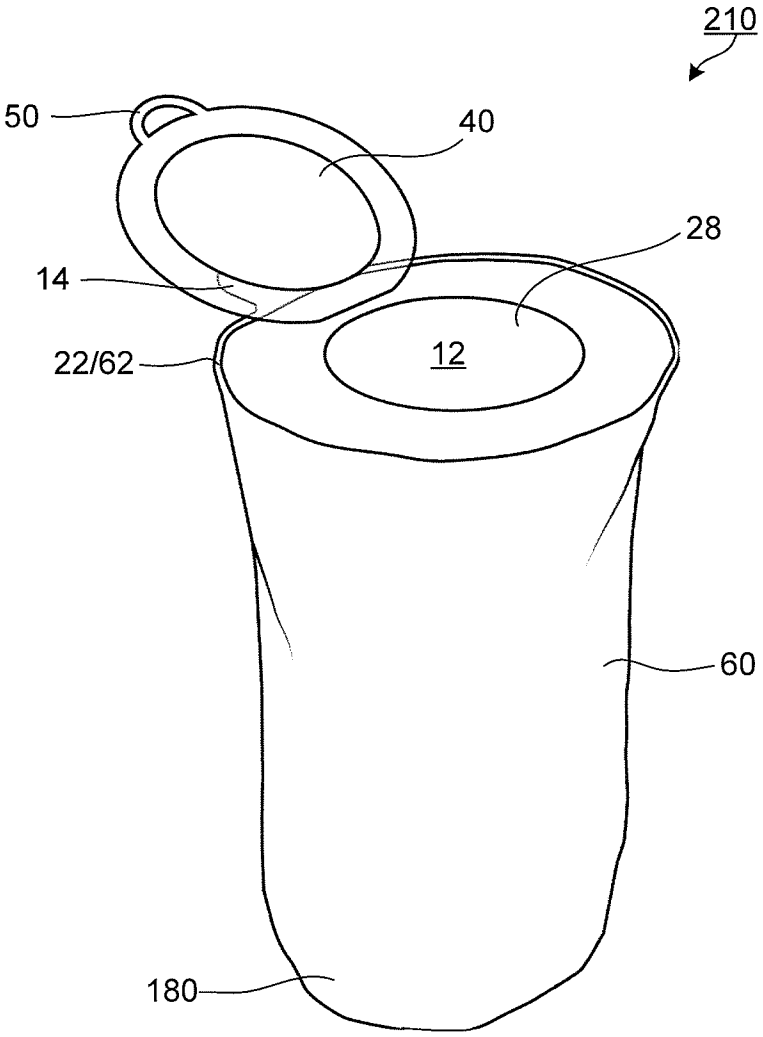
FIG. 19 is an upper perspective view of a sixth embodiment of the flexible pail in an open position.
Figure 22:
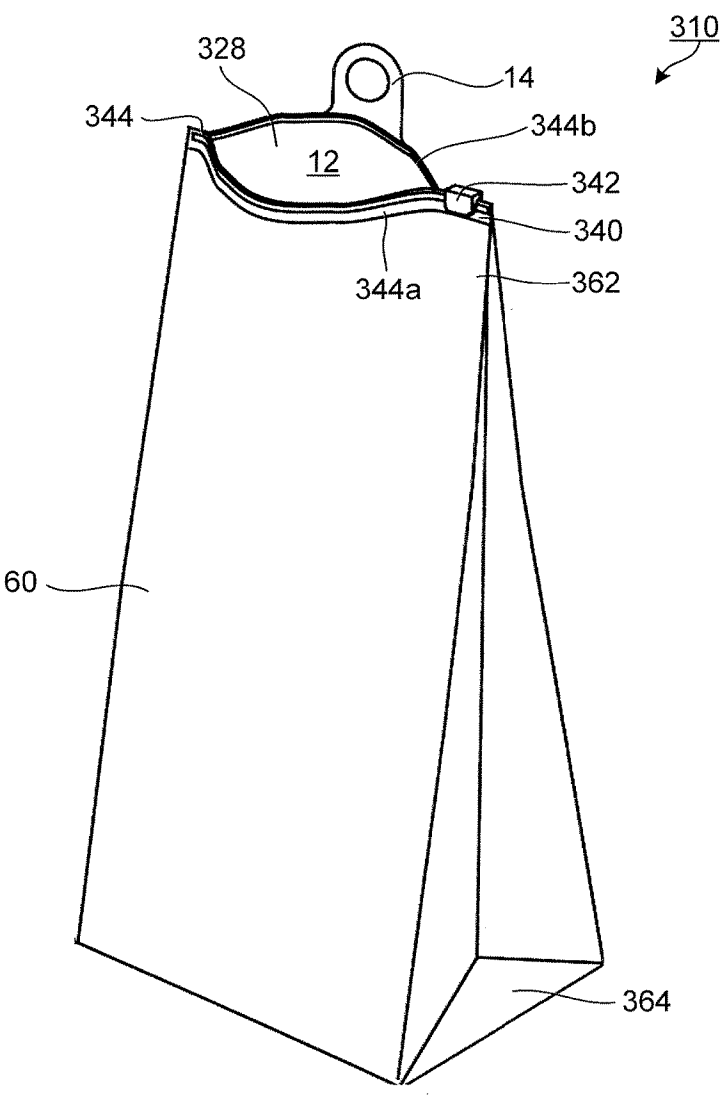
FIG. 22 is an upper perspective view of FIG. 21 in an open position.
Figure 21:
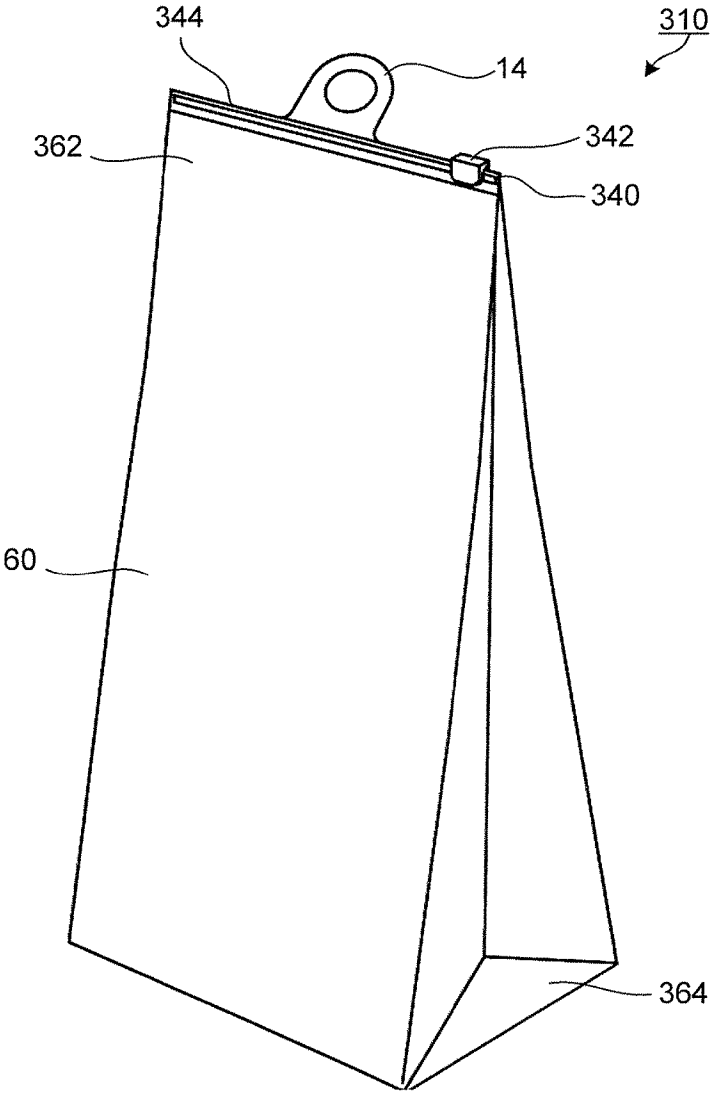
FIG. 21 is an upper perspective view of a seventh embodiment of the flexible pail in a closed position.

FIGS. 19-20 demonstrate a flexible pail 210 having the cover 20 and the container body 60. The cover 20 has a flap 40 attached thereto. The flexible pail 210 does not have a separate base at 180, such as the flexible pail 10 constructed in FIG. 3, which allows the flexible pail 210 to be lighter. Although there is no separately constructed base, the flexible pail 210 may be able to stand due to the rigid properties of the material used for the container body 60. Similar to the above disclosed flexible pail 10, the flexible pail 210 may have a loop 14, Which provides the flexible pail 10 the ability to hang onto a hook or other similar structure. Since the base is integral with the container body 60, the flexible pail 210 may rely more often on the loop 14 to hang instead of stand. The flexible pail 210 may be capable of both hanging and standing.

FIGS, 21-22 illustrate a flexible pail 310 having a single integrated shape with an upper opening 362 and a closed lower end 364. The upper opening 362 may be sealable in a variety of different ways, such as a seal 340. The seal 340 may be incorporated as a two-part strip 344 along an opening 328 that can be pressed together to lock and seal the opening closed. The two-part strip includes two strips 344*a*, 344*b* and a sealing divider 342 that forms a tight seal when pressed together, Likewise, the sealing divider 342 interlocks grooves and ridges disposed along the top portion of the two strips 344*a*, 344*b* and can also separate the two strips 344*a*, 344*b* with sufficient force to detach the two-parts from each other.

In use, the flexible pail 310 is opened, and a waste item is placed through the opening 328 to be disposed into the compartment 12. Thereafter, the two-part strip 344 is pressed together to cause the interlocking grooves and ridges to be interconnected and form a tight seal. It is to be understood that various other suitable methods may be provided to seal the upper end of the flexible pail according to this disclosure.

The illustrations and examples provided herein are for explanatory purposes and are not intended to limit the scope of the appended claims. It will be recognized by those skilled in the art that changes or modifications may be made to the above described embodiment without departing from the broad inventive concepts of the invention. It is understood therefore that the invention is not limited to the particular embodiment which is described, but is intended to cover all modifications and changes within the scope and spirit of the invention.

What is claimed:

1. A flexible diaper pail, comprising:

a container comprising:

a flexible sheet having a first upper end and a second lower end;

a cover attached to the first upper end of the flexible sheet, the cover having an opening;

a base attached to the second lower end of the flexible sheet;

a flexible flap pivotally attached to the cover and adapted to pivot between an open position to receive waste and a closed position to seal in odor; and an odor barrier disposed in the opening, wherein the container is adapted to stand upright.

2. The flexible diaper pail in claim 1, wherein the flexible flap has at least one protrusion.

3. The flexible diaper pail in claim 2, wherein the at least one protrusion provides stability to the flexible flap to secure the flexible flap in the open position.

4. The flexible diaper pail in claim 1, wherein the container is adapted to compress to a height of ¼ inch.

5. The flexible diaper pail in claim 1, wherein the container is adapted to expand to a height 18 inches.

6. The flexible diaper pail in claim 1, wherein the container is adapted to compress and expand.

7. The flexible diaper pail in claim 1, wherein the container is adapted to compress and expand between heights of ¼ inch and 18 inches.

8. The flexible diaper pail in claim 1, wherein the cover has a lip, the lip bonded to the first upper end of the flexible sheet.

9. A flexible diaper pail, comprising:

a container comprising:

a flexible sheet having a first upper end and a second lower end, the flexible sheet adapted to compress and expand;

a cover having an opening and a lip, the lip bonded to the first upper end of the flexible sheet;

a base attached to the second lower end of the flexible sheet;

a flexible flap pivotably attached to the cover adapted to pivot between an open position to receive waste and a closed position to seal in odor; and an odor barrier disposed in the opening, wherein the container is adapted to stand upright.

10. The flexible diaper pail in claim 9, wherein the flexible flap has at least one protrusion that provides stability to the flexible flap in the open position, such that the flexible flap remains open.

11. The flexible diaper pail in claim 9, wherein the container is adapted to compress and expand between heights of ¼ inch and 18 inches.

* * * * *